US007841415B2

(12) United States Patent
Winter

(10) Patent No.: US 7,841,415 B2
(45) Date of Patent: Nov. 30, 2010

(54) IRON ROUGHNECK EXTENSION SYSTEMS

(75) Inventor: Brian Daniel Winter, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 266 days.

(21) Appl. No.: 12/075,613

(22) Filed: Mar. 12, 2008

(65) Prior Publication Data

US 2008/0257607 A1 Oct. 23, 2008

Related U.S. Application Data

(60) Provisional application No. 60/919,828, filed on Mar. 22, 2007.

(51) Int. Cl.
*E21B 23/00* (2006.01)
*E21B 19/16* (2006.01)

(52) U.S. Cl. ..... 166/382; 166/77.51; 166/85.1; 175/85; 175/162; 175/220

(58) Field of Classification Search ..... 166/77.51, 166/85.1, 382; 175/85, 162, 220
See application file for complete search history.

(56) References Cited

U.S. PATENT DOCUMENTS

| | | | | |
|---|---|---|---|---|
| 4,023,449 | A | 5/1977 | Boyadjieff | 81/57.16 |
| 4,234,150 | A | 11/1980 | Mee et al. | 248/281.1 |
| 4,274,778 | A | 6/1981 | Putnam et al. | 414/22 |
| 4,345,864 | A | 8/1982 | Smith, Jr. et al. | 414/22 |
| 4,348,920 | A | 9/1982 | Boyadjieff | 81/57.25 |
| 4,548,544 | A | 10/1985 | Van Appledorn | 414/751 |
| 4,715,761 | A | 12/1987 | Berry et al. | 414/22 |
| 4,725,179 | A | 2/1988 | Woolslayer et al. | 414/22 |
| 4,765,401 | A | 8/1988 | Boyadjieff | 166/77.5 |
| 4,843,945 | A | 7/1989 | Dinsdale | 81/57.34 |
| 4,975,016 | A | 12/1990 | Pellenc et al. | 414/501 |
| 5,049,020 | A | 9/1991 | McArthur | 414/22.51 |
| 5,667,026 | A | 9/1997 | Lorenz et al. | 175/162 |
| 5,842,390 | A | 12/1998 | Bouligny et al. | 81/57.34 |
| 6,142,041 | A | 11/2000 | Buck | 81/57.35 |
| 6,253,845 | B1 | 7/2001 | Belik | 166/77.51 |
| 6,263,763 | B1 | 7/2001 | Feigel, Jr. et al. | 81/57.34 |
| 6,318,214 | B1 | 11/2001 | Buck | 81/57.35 |
| 6,334,376 | B1 | 1/2002 | Torres | 81/372 |
| 6,715,569 | B1 | 4/2004 | Rogers | 175/85 |
| 6,776,070 | B1 | 8/2004 | Mason et al. | 81/57.35 |
| 7,178,612 | B2 * | 2/2007 | Belik | 175/162 |
| 7,249,639 | B2 | 7/2007 | Belik | 175/162 |
| 7,313,986 | B2 | 1/2008 | West et al. | 81/57.16 |
| 7,387,050 | B2 | 6/2008 | Slettedal et al. | 81/57.16 |

(Continued)

OTHER PUBLICATIONS

Star Racker (TM) (SR) with Integrated Iron Roughneck: National Oilwell: 2 pp.: 2002.

(Continued)

*Primary Examiner*—Jennifer H Gay
(74) *Attorney, Agent, or Firm*—Williams, Morgan & Amerson, P.C.

(57) ABSTRACT

Extension systems for iron roughnecks are provided. These systems are equipment apparatuses and extendable/retractable supports for devices used for connecting and disconnecting tubular members (e.g. casing, tubing, pipe, or drill pipe) on drill rigs. The systems in particular relate to iron roughnecks, and methods of moving them on a drilling rig.

16 Claims, 9 Drawing Sheets

U.S. PATENT DOCUMENTS

| | | | | |
|---|---|---|---|---|
| 7,455,128 | B2 * | 11/2008 | Belik | 175/162 |
| 7,559,360 | B2 * | 7/2009 | Hobgood | 166/85.1 |
| 2004/0216906 | A1 | 11/2004 | Rogers | 173/216 |
| 2005/0047884 | A1 * | 3/2005 | Belik | 408/234 |
| 2006/0118335 | A1 * | 6/2006 | Belik | 175/57 |
| 2007/0193750 | A1 * | 8/2007 | Wright et al. | 166/379 |
| 2007/0251728 | A1 * | 11/2007 | Belik | 175/57 |
| 2008/0011470 | A1 * | 1/2008 | Hobgood | 166/77.1 |
| 2008/0217067 | A1 * | 9/2008 | Ge | 175/85 |
| 2009/0065189 | A1 * | 3/2009 | Hobgood | 166/77.51 |

OTHER PUBLICATIONS

Hydraulic Roughneck: Maritime Hydraulics: General Catalogue 1993-1994: 3 pp.: 1993.

Compact. Portable and powerful Iron Roughneck for all rig types: Varco Systems. Varco L.P.: 2 pp.: 2003.

Iron Roughneck IR-3080: National Oilwell: 6 pp.: 2001.

* cited by examiner

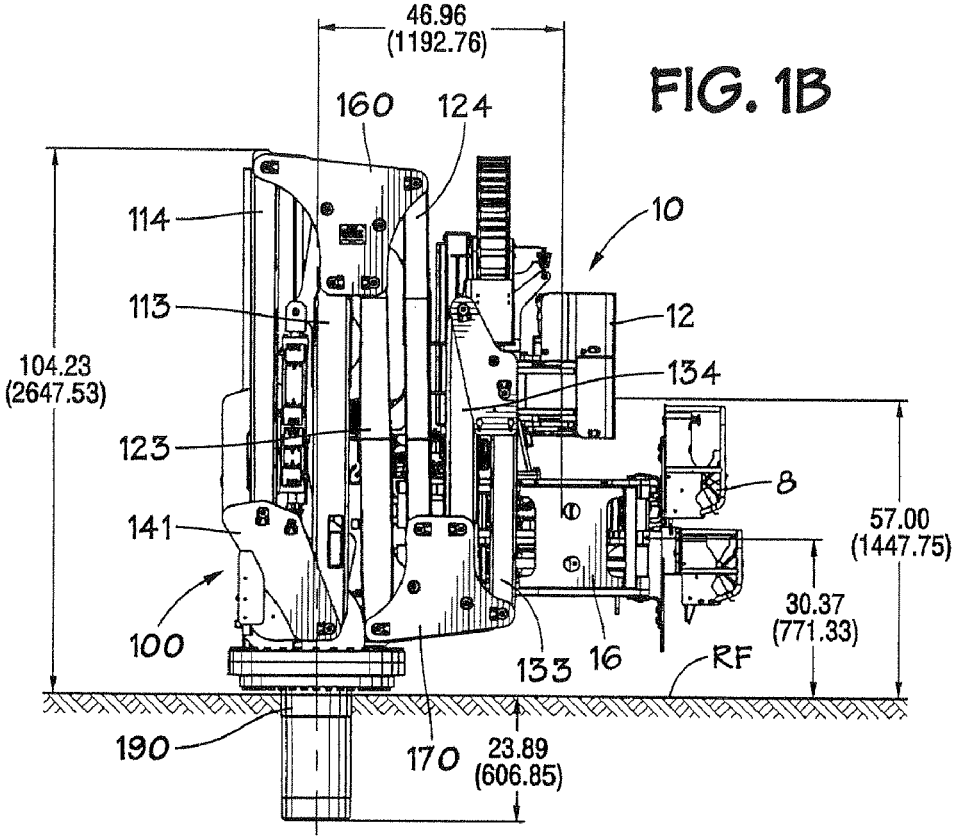
FIG. 1B
FIG. 1C
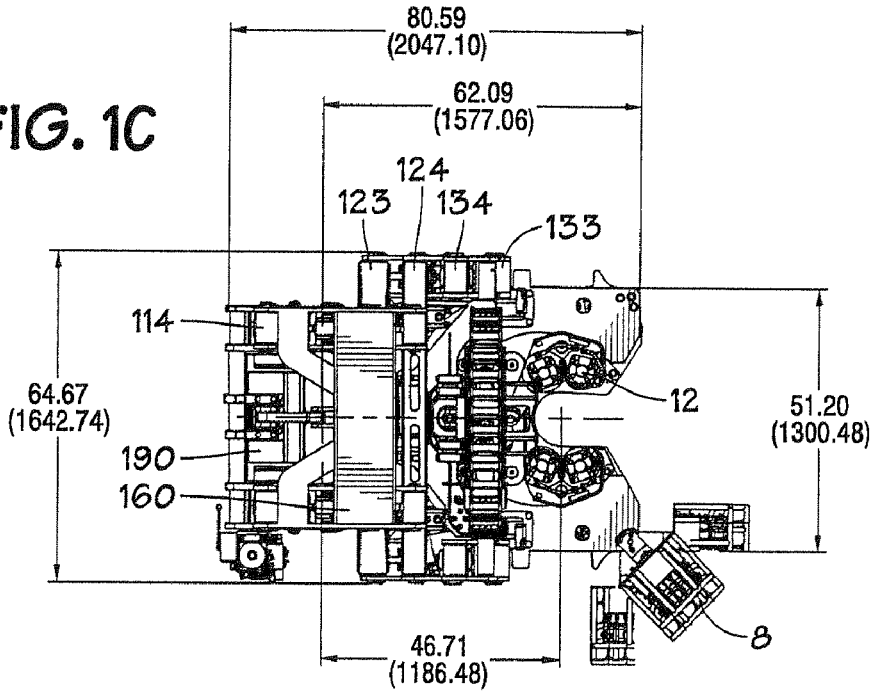

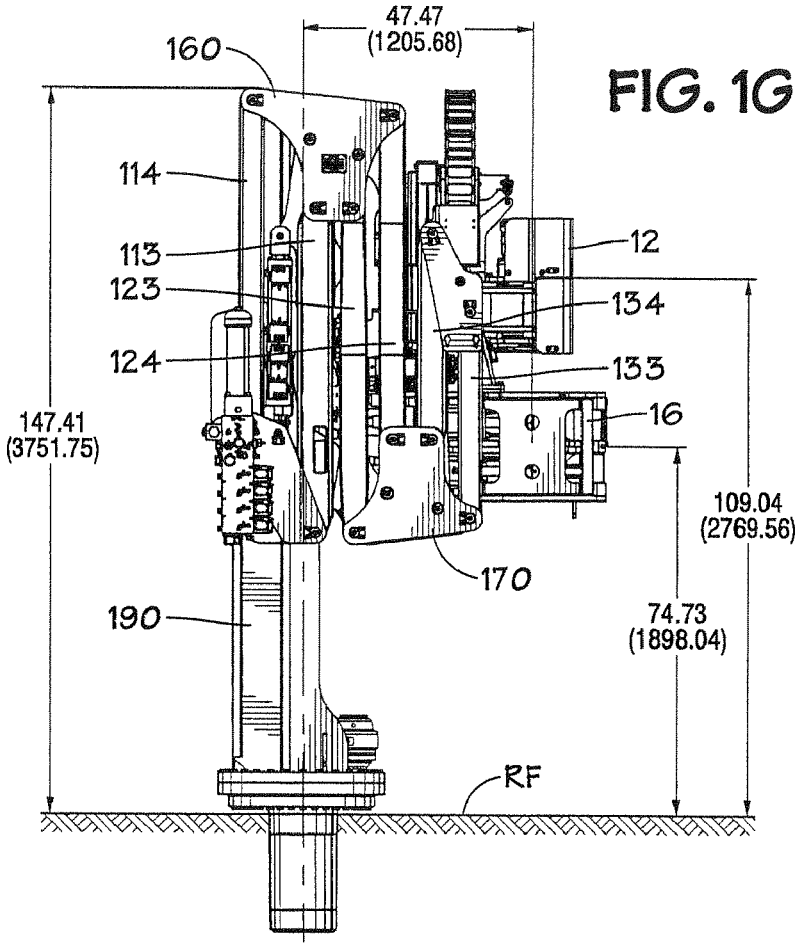
FIG. 1G
FIG. 1H
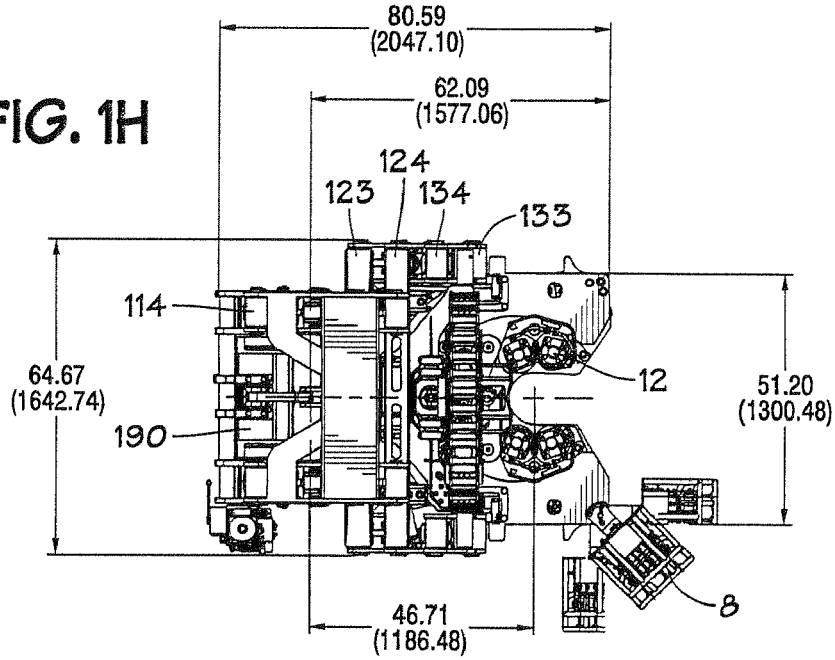

FIG. 5
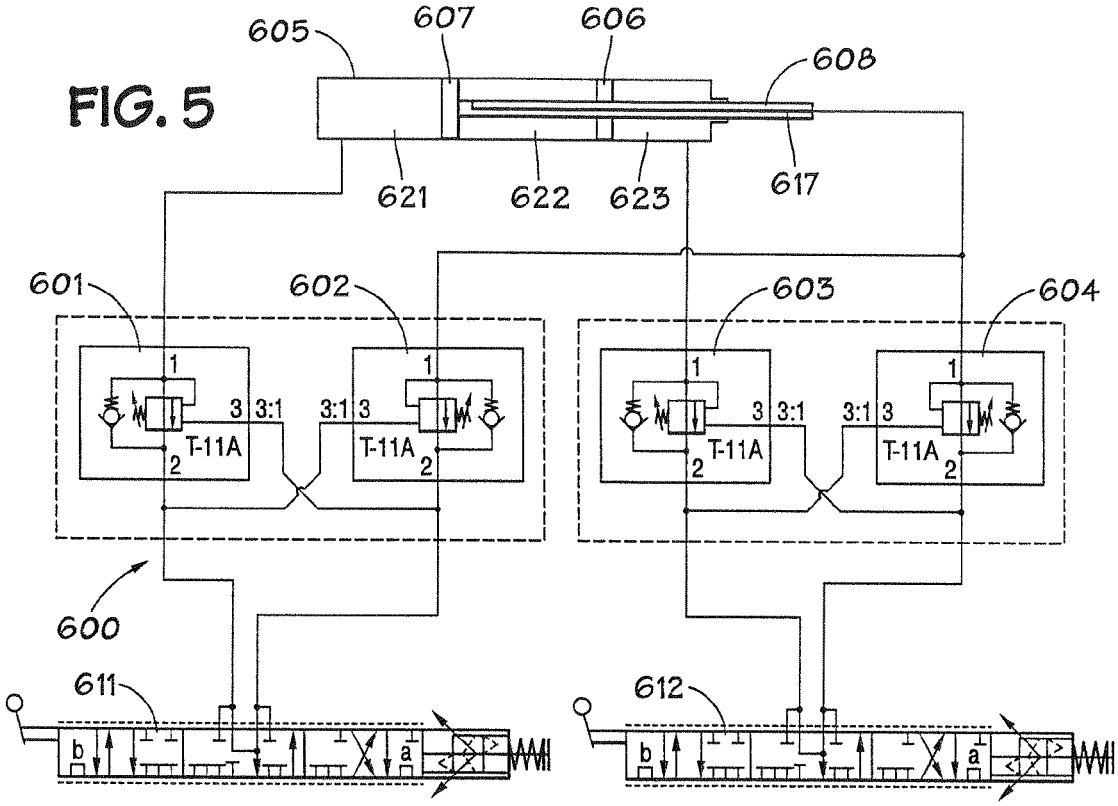
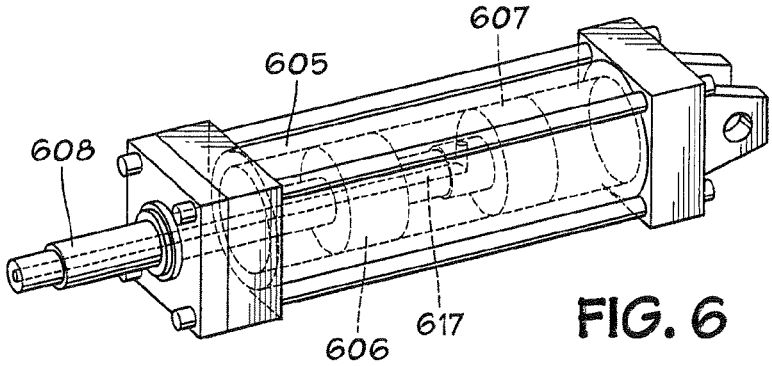
FIG. 6
FIG. 7
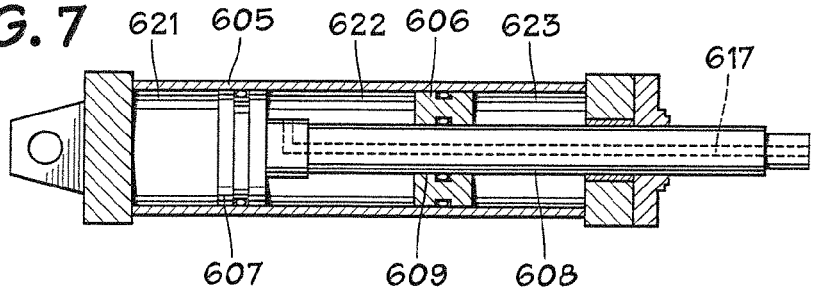

IRON ROUGHNECK EXTENSION SYSTEMS

CROSS REFERENCE TO RELATED APPLICATION

The present invention and application claim priority under the U.S. Patent Laws, Title 35, §120 from U.S. Patent Application 60/919,828 filed Mar. 22, 2007, incorporated fully herein for all purposes.

BACKGROUND OF THE INVENTION

1. Field of the Invention

The present invention is directed to equipment apparatuses; extendable/retractable supports for apparatus for connecting and disconnecting tubular members (e.g. casing, tubing, pipe, or drill pipe); and, in certain particular aspects, to iron roughnecks and methods of moving them on a drilling rig.

2. Description of Related Art

"Iron roughnecks," combine a torque wrench and a spinning wrench to connect and disconnect tubulars, e.g. drilling components, e.g. drill pipe, in running a string of tubulars into or out of a well. Prior art tong systems and iron roughnecks are shown. e.g., in U.S. Pat. Nos. 4,023,449; 4,348,920; 4,765,401; 6,318,214; 6,776,070; 7,249,639; and 7,313,986—all of which are incorporated herein by reference in their entirety.

Various prior art iron roughnecks have a spinning wrench and a torque wrench mounted together on a support structure or carriage. Certain iron roughnecks are mounted on an extendable and retractable support structure for movement to and from a wellbore center without interfering with or blocking performance of other operations relative to the well and rotating or driving apparatuses.

U.S. Pat. No. 7,249,639, co-owned with the present invention, discloses an apparatus for moving an Iron Roughneck into position to allow making-up or breaking-out of threaded joints in a drill string. The apparatus may also be used to move other drilling equipment into position on the centerline of the well or at mouseholes. A self-balanced, dual synchronized parallelogram arm is utilized to accomplish the movement of the devices. Hydraulic or pneumatic cylinders are used for extension and retraction of the arm rather than to support the tool. The arm may hold the tool in any position without cylinder assistance. The linkage in the synchronized parallelogram may be accomplished by gears, links, slots, or rollers. In certain aspects, an apparatus is disclosed for moving drilling equipment having: a column attached to a drill floor; a column guide attached to the column; at least one parallelogram arm attached to the column guide at a first connection point, the at least one parallelogram arm comprising a tension link, a lower support arm, an upper support arm, a compression link, and a load transfer joint; a drilling apparatus attached to the parallelogram arm at a second connection point; and a cylinder attached to the column guide for raising and/or lowering the column guide along the column.

U.S. Pat. No. 7,313,986, co-owned with the present invention, discloses a system with a torque wrench and a spinning wrench on a carriage which is movably connected for up/down vertical movement to a column and which can also translate horizontally on a rig floor for movement toward and away from a drill pipe of a drill string in a well. Support arms are pivotably connected at one end to a base of the carriage and at their other ends to a support. Optionally, only one support arm is used or two arms in parallel are used. A connector is removably emplaceable in a socket to mount the system on a rig. In one particular aspect the dual arms move the spinner/wrench combination outwardly 24" from the column which results in a 6.5" rise vertically. The wrenches are movable by a power mechanism toward and away from the column 14 by moving the support arms. The spinning wrench is movable up and down on the carriage toward and away from the torque wrench. A control console for the communicates by wire or wirelessly with the system components and can be located remotely.

SUMMARY OF THE PRESENT INVENTION

The present invention, in certain embodiments, discloses an extension system for an iron roughneck, the iron roughneck including an iron roughneck support and a torque wrench and a spinning wrench on the iron roughneck support, the extension system having: a stem; a support column on the stem; a mount movably connected to the support column and movable up and down thereon; three pivotably interconnected parallelogram linkage structures; raising apparatus connected to the support column and for raising and lowering the mount with respect to the support column; powered extension apparatus connected to the mount and to a first linkage structure; the linkages pivotable and movable by the powered extension apparatus to extend the iron roughneck support away from the support column and to retract the iron roughneck toward the support column. In certain aspects, such a system can raise and extend or lower and retract the iron roughneck simultaneously.

In certain aspects, the present invention discloses methods for moving an iron roughneck on a rig, the method including: connecting the iron roughneck to an extension system according to the present invention; and moving the iron roughneck with the extension system.

Accordingly, the present invention includes features and advantages which are believed to enable it to advance iron roughneck extension system technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, there are other objects and purposes which will be readily apparent to one of skill in this art who has the benefit of this invention's teachings and disclosures.

It is, therefore, an object of at least certain preferred embodiments of the present invention to provide new, useful, unique, efficient, non-obvious systems and methods for moving iron roughnecks and extension systems for iron roughnecks.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention. Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 1B is a side view of the system of FIG. 1A.

FIG. 1C is a top view of the system of FIG. 1A.

FIG. 1G is a side view as shown in FIG. 1D.

FIG. 1H is a top view as shown in FIG. 1G.

FIG. 5 is a schematic view of a control circuit and piston/cylinder according to the present invention.

FIG. 6 is a perspective view of a piston/cylinder of the system of FIG. 5.

FIG. 7 is a side cross-section view of the piston/cylinder of FIG. 6.

DETAILED DESCRIPTION OF THE INVENTION

Figure 1A:
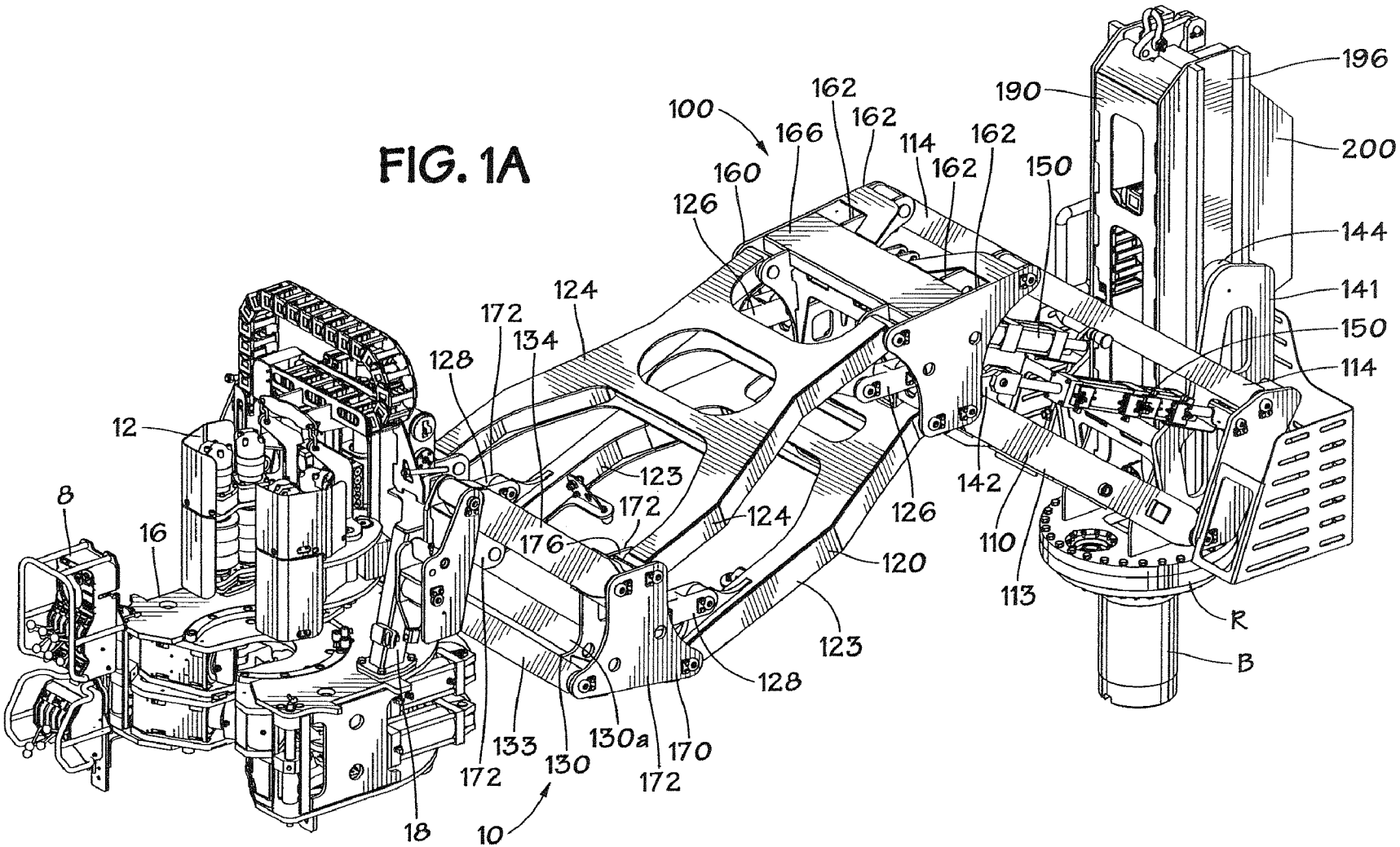
FIG. 1A is a perspective view of a system according to the present invention.

FIG. 1A shows a system 10 according to the present invention with an extension system 100 according to the present invention. A spinner 12 and a wrench 16 are movably mounted on to a support 18. The spinner 12 may be any suitable spinner. In one particular aspect, the spinner 12 is like a spinning wrench disclosed in U.S. application Ser. No. 12/072,296 filed Feb. 25, 2008 (co-owned with the present invention and incorporated fully herein for all purposes) and the wrench 16 is a torque wrench as disclosed in U.S. Pat. No. 7,313,586 (co-owned with the present invention and incorporated fully herein for all purposes). A control system 8 controls the spinner 12, the wrench 16, and the system 100.

The extension system 100 as shown in FIG. 1A has three pivotable interconnected linkage sections 110, 120, 130 providing for extension and retraction of the spinner-12-wrench-16 combination. The linkage section 130 is connected to the support 18.

Each linkage section has pivotable upper and lower members which form an expandable/contractable parallelogram structure. The linkage 110 has lower arms 113 and upper arms 114. Lower arm ends are pivotably connected to a mount 141 and upper arm ends are pivotably connected to a connection 160. The connection 160 includes spaced-apart side plates 162; connection members 165 (see FIG. 1L); and cross-structure 166. The arms 113 each have an end pivotably connected to a connection member 165. During movement, the arms 113 move parallel to the arms 114.

Figure 1E:
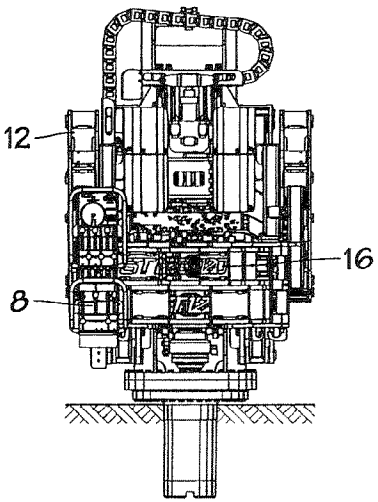
FIG. 1E is a front view as shown in FIG. 1D.
Figure 1D:
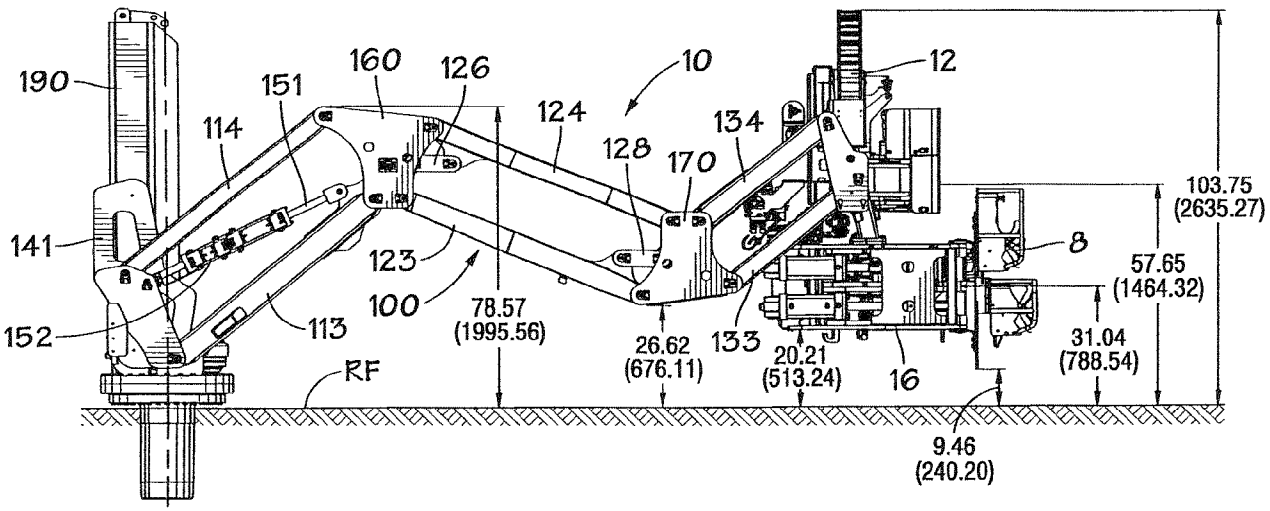
FIG. 1D is a side view of the system of FIG. 1A.
Figure 1F:
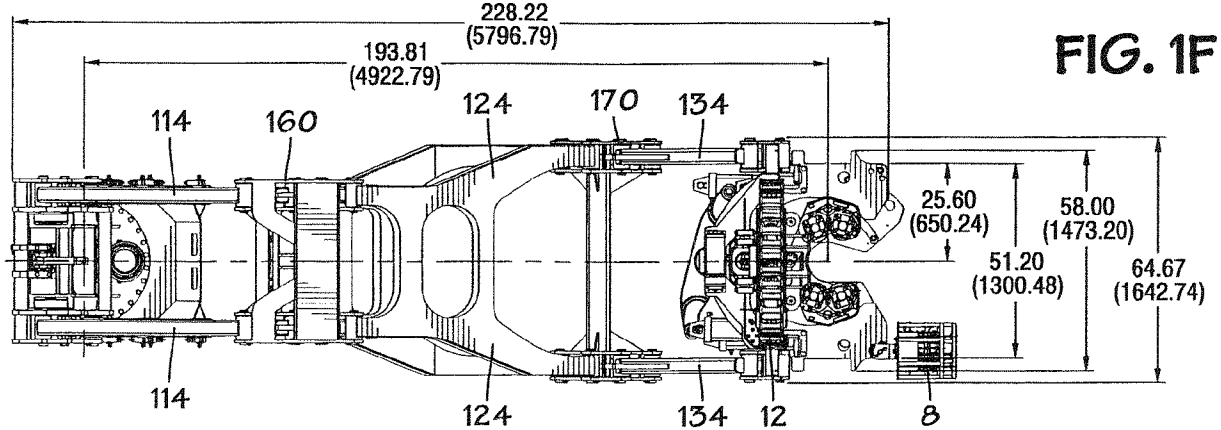
FIG. 1F is a top view as shown in FIG. 1D.
Figure 1J:
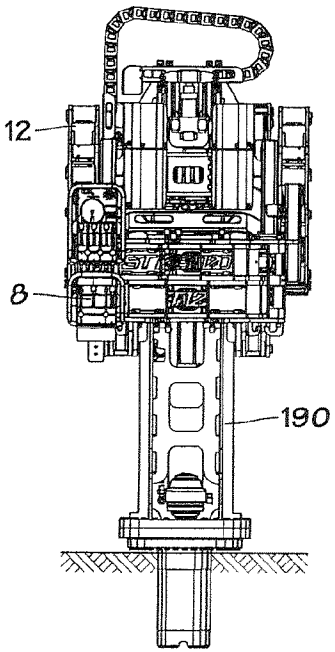
FIG. 1J is a front view as shown in FIG. 1I.
Figure 1I:
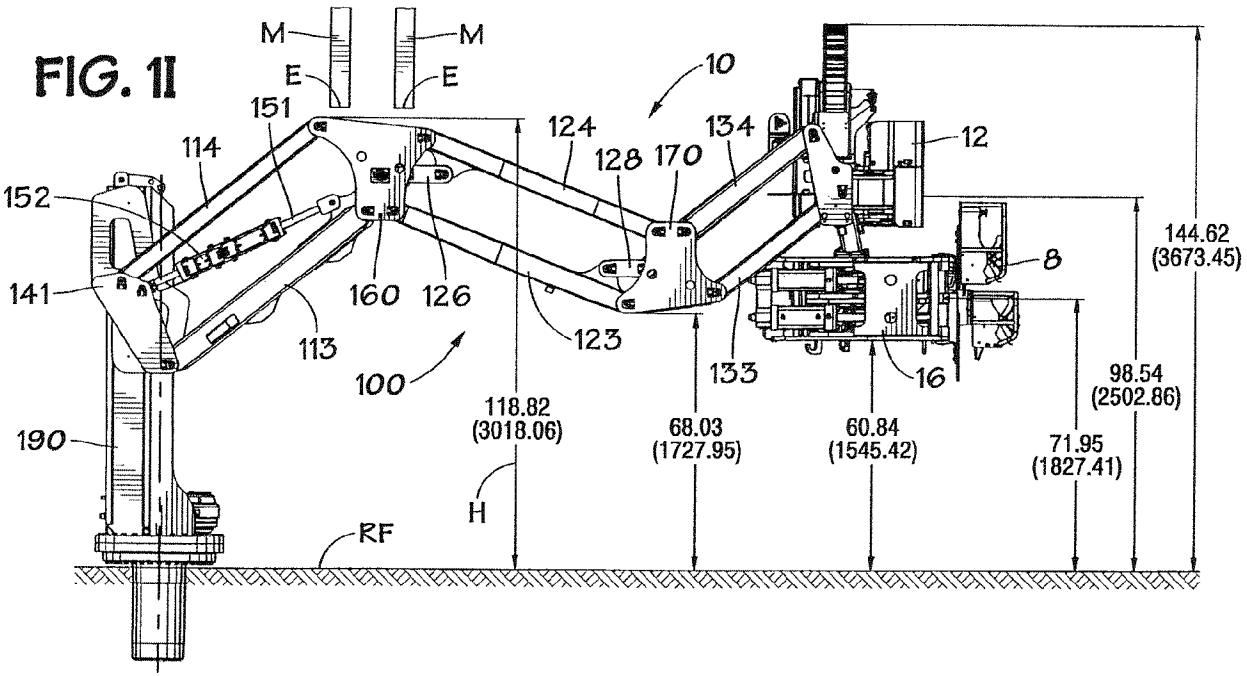
FIG. 1I is a side view as shown in FIG. 1A.
Figure 1K:
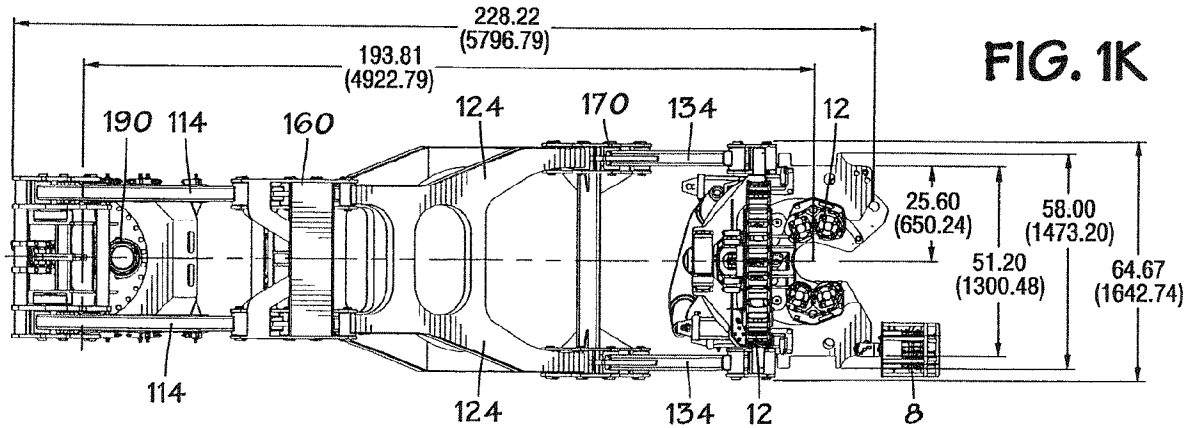
FIG. 1K is a top view as shown in FIG. 1I.
Figure 1L:
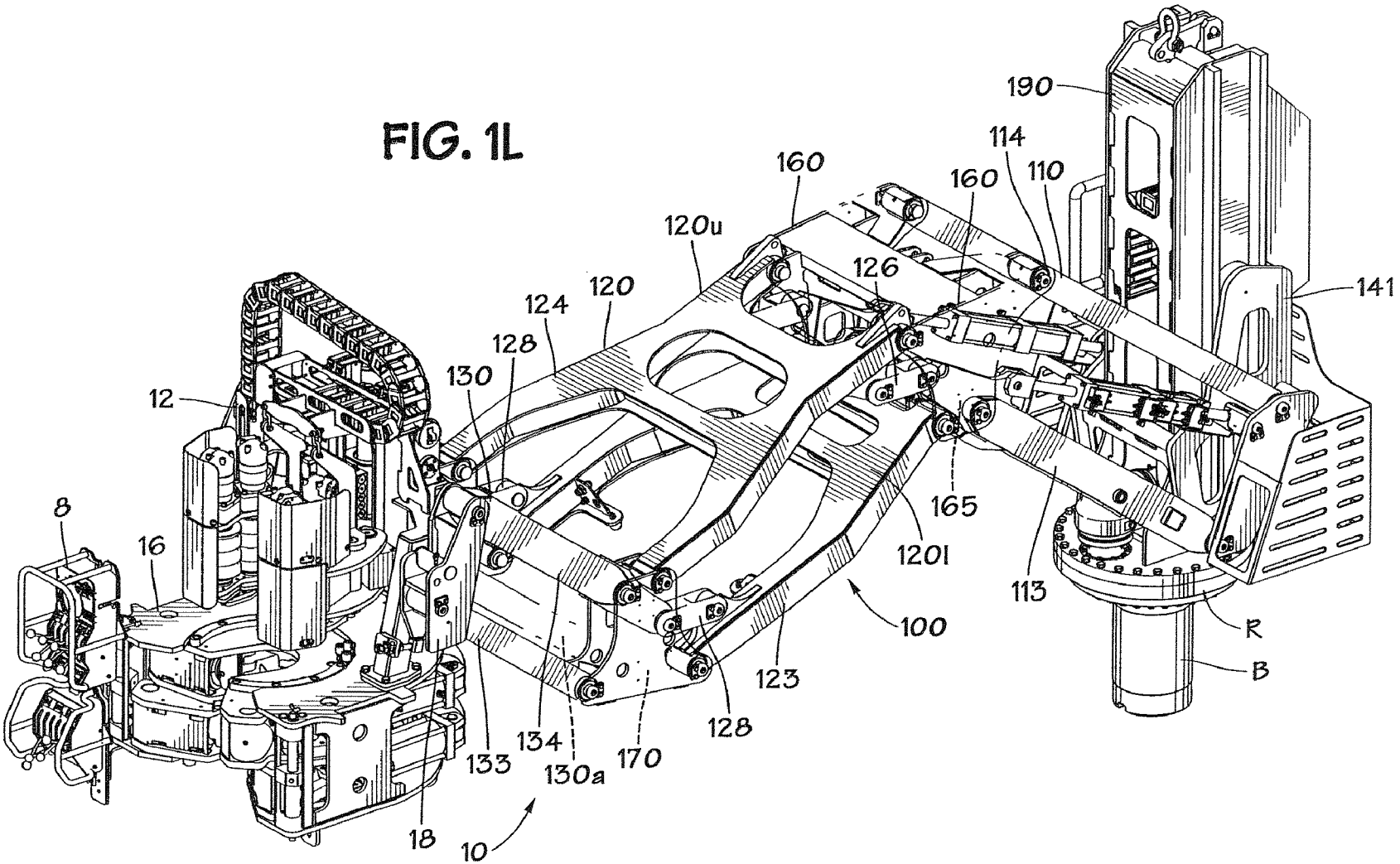
FIG. 1L is a partial perspective view of the system of FIG. 1A.

The linkage 120 has a lower part 1201 with lower arms 123 and an upper part 120*u* with upper arms 124 (see FIGS. 1A and 1L). Two ends of the lower part 1201 and of the upper part 120*u* are pivotably connected to the connection 160 and two opposing ends of each arm 123, 124 are pivotably connected to a connection 170. Links 126 each have a first end pivotably connected to the upper part 120*u* and a second end pivotably connected to a connection member 165. Links 128 each have a first end pivotably connected to a lower arm 123 and a second end pivotably connected to an upper arm 134 of the linkage 130.

The linkage 130 has a cross beam 130*a*, lower arms 133, and upper arms 134. First parts of the upper arms 134 and of the lower arms 133 are pivotably connected to the connection 170. Second ends of the lower arms 133 and of the upper arms 134 are pivotably connected to the support 18.

The connections 170 have side plates 172 and cross-structure 176.

The mount 141 has rollers 144 which are located to roll in channels 196 of a column 190. The column 190 is rotatable on a bearing R with respect to a stem B. A system 200 (shown schematically) raises and lowers the mount 141 and thus the system 100. It is within the scope of the present invention to use any suitable known system for the system 200 and for the system (all or some parts thereof) to reside within the column 190. In certain aspects, the system 200 employs a lifting cylinder apparatus, e.g. as shown in U.S. Pat. No. 7,249,639, incorporated fully herein for this purpose.

FIGS. 1B-1K illustrate various positions of the system 10 and the system 100. The mount 141 and the column 190 rotate with respect to the stem B. The linkages 110, 120, 130 are moved by extending piston shafts of hydraulic cylinder apparatuses 150 which are connected between a mount 141 on the support column 190 and connections 142 on the lower arms 113. Optionally, only one apparatus 150 is used. A piston 151 is movable with respect to a cylinder 152 to move up and out to extend the system 100 and in and down to retract it.

FIGS. 1B and 1C show the system 100 fully retracted and fully lowered on the column 190 down to a rig floor RF. Arms 114 are parallel to arms 113; arms 124 are parallel to arms 123; and arms 134 are parallel to arms 133. The pistons 151 have not been extended from their respective cylinders 152.

FIGS. 1D-1F show the system 100 fully extended by extending the pistons 151 from their respective cylinders 152. Upper arms remain parallel to lower arms and the system 100 remains in a lowered position with respect to the rig floor RF.

FIGS. 1G and 1H shows the systems 10 and 100 in a fully raised position on the column 190 and fully retracted horizontally. Upper arms remain parallel to lower arms and the pistons 151 remain retracted in their cylinders 152.

FIGS. 1I-1K shows the system 100 fully extended and fully raised. In the pairs of arms, the upper arms are parallel to the lower arms and the pistons 151 have been extended to extend the system.

In FIGS. 1B-1F and 1G-1I several heights, lengths, and distances (for certain particular embodiments of the present invention) are indicated by dual measurements in inches and in millimeters. For example, in FIG. 1B the entry "104.23" above the entry "[2647.53]" indicates the height indicated at that point is 104.23 inches and 2647.53 millimeters. As shown in FIG. 1I, the height H is 118.82 inches and 3018.06 millimeters (which is less than a height of 120 inches—which is the distance, in one aspect, from the rig floor RF to the bottom of ends E of rails M (shown partially) which are rails in the rig on which a top drive moves up and down.

Figure 3:
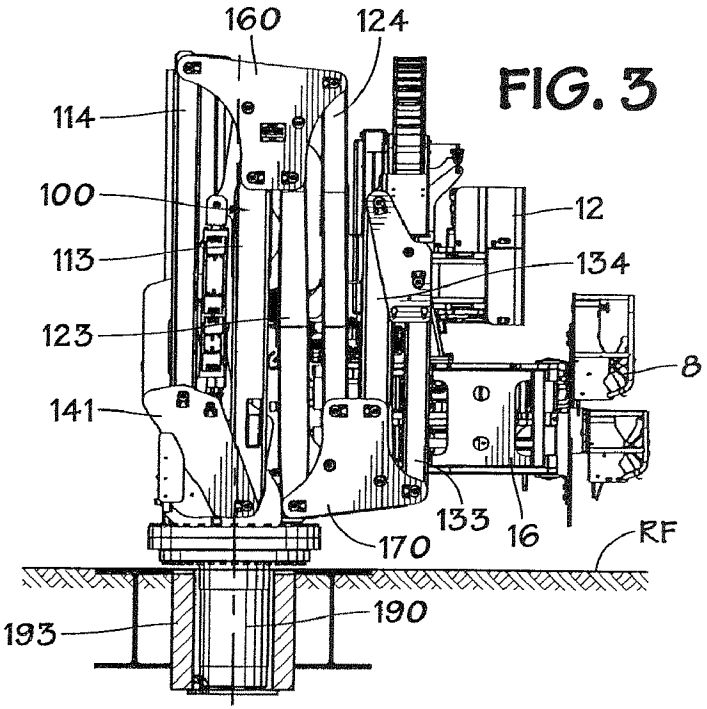
FIG. 3 is a side view of the system of FIG. 1A.
Figure 2:
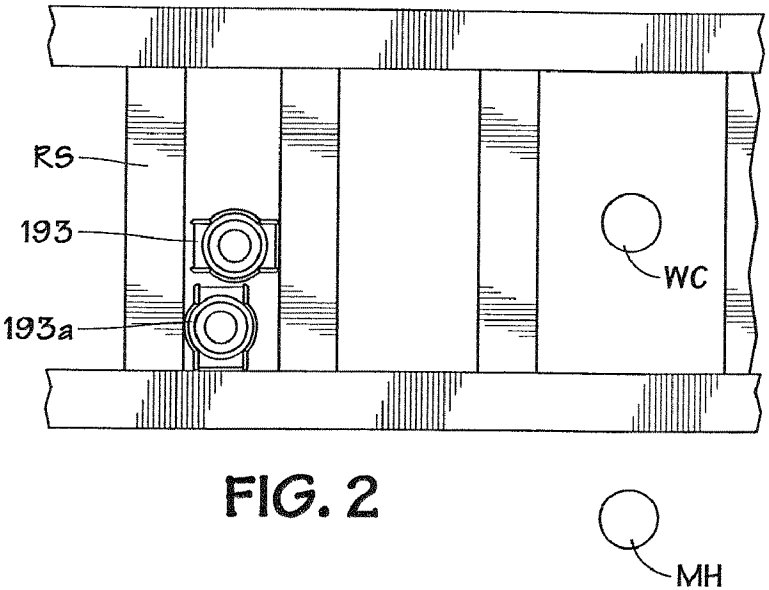
FIG. 2 is a top view of part of the system of FIG. 1A.

FIG. 3 shows the system 100 with the column 190 mounted in a floor socket 193. FIG. 2 shows the location of the floor socket 193 on rig structure RS. Optionally, the floor socket is positioned as desired (see e.g. a floor socket 193*a*). The rig is located over a well center WC and adjacent a mousehole MH.

Figure 4A:
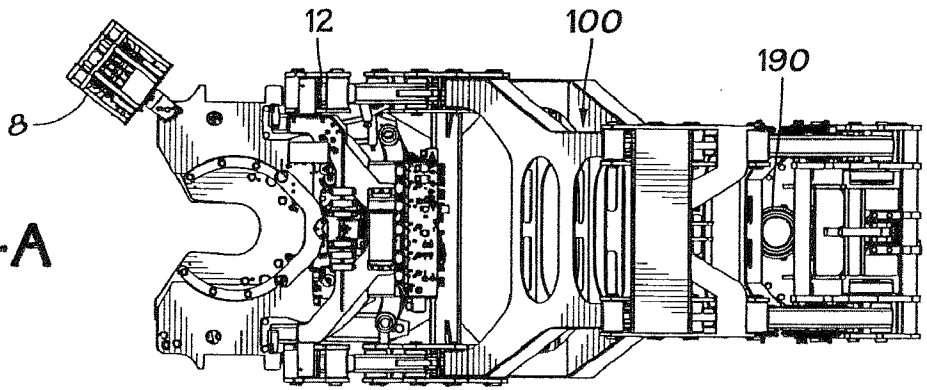
FIG. 4A is a top view of the system of FIG. 1A.
Figure 4C:
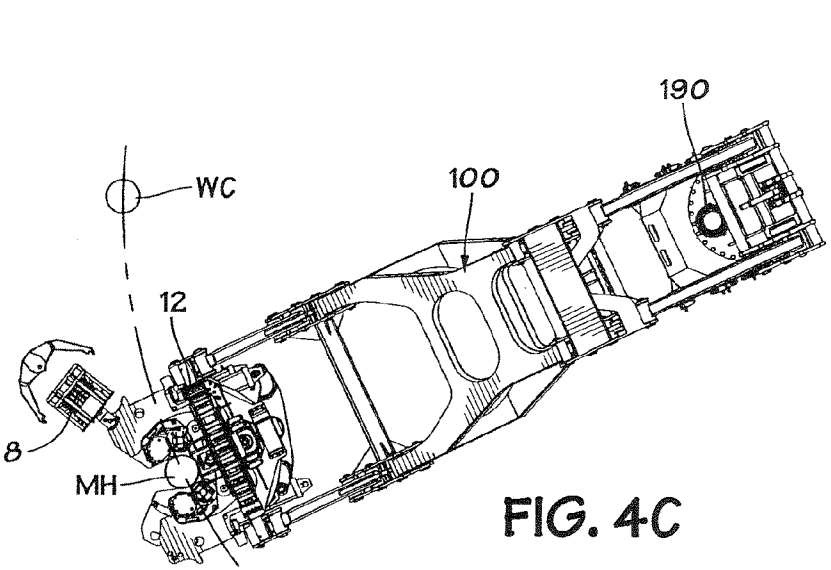
FIG. 4C is a top view of the system of FIG. 1A.
Figure 4B:
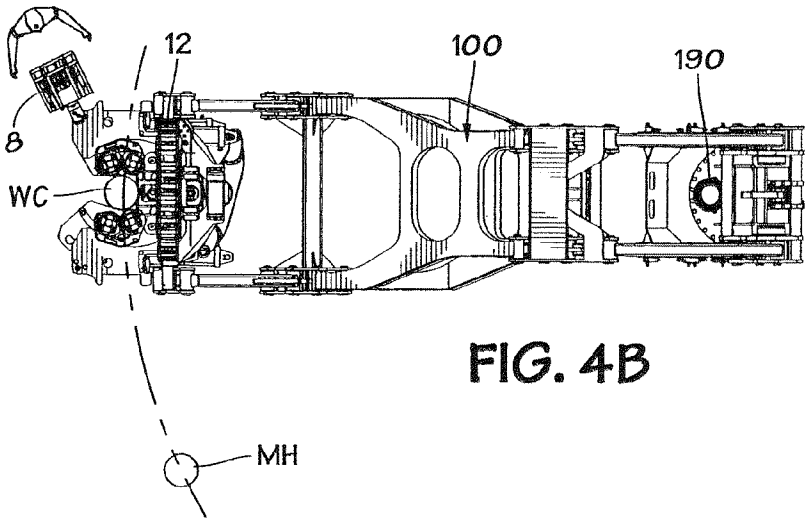
FIG. 4B is a top view of the system of FIG. 1A.

FIGS. 4A-4D illustrate various positions for the system 10 and the system 100. In FIG. 4A the systems are in a standby position with the system 100 fully lowered and fully retracted. As shown in FIG. 4B, the system 100 has extended to position the system 10 with the spinner 12 and wrench 16 over the well center WC.

Figure 4D:
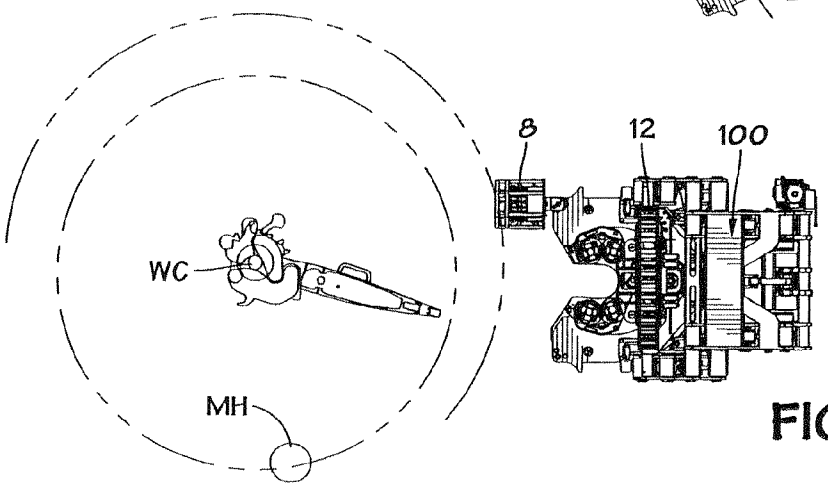
FIG. 4D is a top view of the system of FIG. 1A.

As shown in FIG. 4C, the system 10 has rotated on the column 190 to position the spinner 12 and wrench 16 above the mousehole MH. FIG. 4D illustrates "tong sweep", i.e., the clearance of drill floor tongs with respect to the system 100 and shows that the system 100 can be retracted to get out of the way of a tong.

It is within the scope of the present invention to use any suitable known power cylinder systems for moving the linkages 110-130. Optionally, an hydraulic cylinder system 600 according to the present invention as shown in FIGS. 5-7 may be used for the cylinder apparatuses 150.

The system 600 has four counterbalance valves 601, 602, 603, 604 and two control valves 611, 612. A housing 605 encloses an inner floating piston 606 and a piston 607 to which is connected and from which extends a shaft 608. The shaft 608 is movable within a bore 609 through the floating piston 606. The pistons 606 and 607 divide the housing into three chambers 621, 622, and 623. Hydraulic fluid under pressure flows into and out of the middle chamber, chamber 622, via a channel 617 through the shaft 608. Both counterbalance valve 602 and counterbalance valve 604 can control flow in the channel 617, thus controlling flow in and fluid pressure in the chamber 622. The control valve 612 controls the floating piston 606 by controlling the counterbalance valves 603, 604. The control valve 611 controls the movement of the piston 607. Counterbalance valve 601 controls flow of hydraulic fluid under pressure into and out of the chamber 621. Counterbalance valve 603 controls flow for the chamber 623.

The location of the floating piston 606 determines the extent of travel of the piston 607 and thus of the shaft 608. The pressures of fluid on either side of the floating piston 606 determine the location of the floating piston 606. In turn, by controlling the location of the floating piston 606 and thereby controlling the extent to which the piston 607 and the shaft 608 can move, the travel of the linkages 110, 120, 130 is controlled With the control of the extent of travel of the system, the floating piston 606 can be set at a preselected location so that when the piston 607 moves and moves to the limit of its travel, the spinner/wrench combination moves to and stops at a pre-selected position, e.g. (but not limited to) to well center.

In certain embodiments of a system according to the present invention, a reach is provided of about twelve feet. In certain embodiments, the vertical height of the spinner/wrench combination varies insignificantly as the system is extended and retracted, e.g. in certain aspects only plus-or-minus 0.75 inches or less. With respect to embodiments as shown in FIG. 1A, if the piston/cylinder apparatuses fail, the system will not abruptly extend or retract and it will not fall.

In certain aspects, in certain rigs with a top drive system, a top drive moves up and down on rails connected to the rig structure. These rails have bottom ends a certain distance above a rig floor (e.g., in one particular aspect, 120 inches above a rig floor). It is advantageous for a system like the system 10 with a system 100 to project upwardly in the rig no further than immediately below the bottom of these rails. Certain embodiments of systems according to the present invention (e.g. as in FIG. 1A) in a fully raised position are less than 120 inches above a rig floor on a rig with rails whose bottoms are 120 inches above the rig floor.

The present invention, therefore, in some, but not necessarily all embodiments and aspect, provides an extension system for an iron roughneck, the iron roughneck having an iron roughneck support and a torque wrench and a spinning wrench on the iron roughneck support, the extension system including: a stem; a support column on the stem; a mount movably connected to the support column and movable up and down thereon; a first linkage with a first linkage first end pivotably connected to the mount and a first linkage second end; a second linkage with a second linkage first end pivotably connected to the first linkage second end and a second linkage second end; a third linkage with a third linkage first end pivotably connected to the second linkage second end and a third linkage second end pivotably connected to the iron roughneck support; raising apparatus connected to the support column for raising and lowering the mount with respect to the support column; powered extension apparatus connected to the mount and to the first linkage; and the first linkage, the second linkage, and the third linkage pivotable and movable by the powered extension apparatus to extend the iron roughneck support away from the support column and to retract the iron roughneck toward the support column. Such a system may have one or some, in any possible combination, of the following: each linkage is a parallelogram structure with upper and members and lower members, the upper members movable parallel to the lower members, a first connection between the first linkage and the second linkage, the upper members of the first linkage and the upper members of the second linkage pivotably connected to the first connection at a top thereof, the lower members of the first linkage and the lower members of the second linkage pivotably connected to the second connection at a bottom thereof, a second connection between the second linkage and the third linkage, the upper members of the second linkage and the upper members of the third linkage pivotably connected to the second connection at a top thereof, and the lower members of the second linkage and the lower members of the third linkage pivotably connected to the second connection at a bottom thereof; wherein the raising apparatus and the powered extension apparatus can act simultaneously; wherein the support column is rotatable with respect to the stem; wherein, during movement of the linkages, vertical height of the iron roughneck varies insignificantly; wherein, during movement of the linkages, vertical height of the iron roughneck varies no more than plus-of-minus 0.75 inches; wherein the powered extension apparatus for extending the iron roughneck is at least one powered piston-cylinder apparatus; wherein the powered extension apparatus for extending the iron roughneck includes two spaced-apart powered piston-cylinder apparatuses; wherein the at least one powered piston-cylinder apparatus includes a housing, an inner floating piston movable within the housing, a shaft extending through the inner floating piston and movable with respect thereto, the shaft having two ends and a shaft piston on one end thereof, the shaft piston movable in the housing, and the shaft having an internal channel through which fluid is flowable from an exterior of the housing into a middle chamber, the inner floating piston and the shaft piston dividing an interior of the housing into three chambers including a first end chamber, the middle chamber, and a second end chamber, the shaft connected to the first linkage, and the shaft piston and the shaft locatable by moving fluid into the housing so that the location of the shaft in the housing corresponds to the location of the first linkage and to the location of the iron roughneck; wherein the control system controls the location of the shaft piston; wherein the inner floating piston is locatable at a pre-set desired position so that, when the inner floating piston is contacted by the shaft piston and the shaft piston ceases movement, the iron roughneck is at a pre-selected position; wherein the control system includes valve apparatus selectively operable to control flow of fluid to the internal channel of the shaft, to the first end chamber, and to the second end chamber; wherein the iron roughneck is positionable with respect to lower ends of support rails for a top drive on a rig so that an uppermost part of the extension system is below and spaced-apart from the lower ends of the support rails; and/or wherein the raising apparatus can raise a topmost part of the first linkage to an uppermost height, said uppermost height less than a height of bottom ends of top drive support rails adjacent the extension system.

The present invention, therefore, in some, but not necessarily all embodiments and aspect, provides an extension system for an iron roughneck, the iron roughneck having an iron roughneck support and a torque wrench and a spinning wrench on the iron roughneck support, the extension system including: a stem; a support column on the stem; a mount movably connected to the support column and movable up and down thereon; a first linkage with a first linkage first end pivotably connected to the mount and a first linkage second end; a second linkage with a second linkage first end pivotably connected to the first linkage second end and a second linkage second end; a third linkage with a third linkage first end pivotably connected to the second linkage second end and a third linkage second end pivotably connected to the iron roughneck support; raising apparatus connected to the support column for raising and lowering the mount with respect to the support column; powered extension apparatus connected to the mount and to the first linkage; the first linkage, the second linkage, and the third linkage pivotable and movable by the powered extension apparatus to move the iron roughneck support with respect to the support column; each linkage comprises a parallelogram structure with upper and members and lower members; a first connection between the first linkage and the second linkage; the upper members of the first linkage and the upper members of the second linkage pivotably connected to the first connection at a top thereof; the lower members of the first linkage and the lower members of the second linkage pivotably connected to the second connection at a bottom thereof; a second connection between the second linkage and the third linkage; the upper members of the second linkage and the upper members of the third linkage pivotably connected to the second connection at a top thereof; the lower members of the second linkage and the lower members of the third linkage pivotably connected to the second connection at a bottom thereof; wherein the raising apparatus and the powered extension apparatus can act simultaneously; the support column rotatable with respect to the stem; wherein, during movement of the linkages, vertical height of the iron roughneck varies no more than plus-of-minus 0.75 inches, and the raising apparatus can raise a topmost part of the first linkage to an uppermost height, said uppermost height less than a height of bottom ends of top drive support rails adjacent the extension system.

The present invention, therefore, in some, but not necessarily all embodiments and aspect, provides a method for moving an iron roughneck on a rig, the method including: connecting the iron roughneck to an extension system, the extension system as any according to the present invention; and moving the iron roughneck with the extension system. Such a method may include one or some, in any possible combination, of the following: simultaneously raising the mount and extending the three linkages thereby raising the iron roughneck and moving the iron roughneck away from the mount; simultaneously lowering the mount and retracting the three linkages thereby lowering the iron roughneck and moving the iron roughneck toward from the mount; raising a topmost part of the first linkage to an uppermost height, said uppermost height less than a height of bottom ends of top drive support rails adjacent the extension system; and/or extending the linkages with a powered piston-cylinder apparatus as any disclosed herein, including, but not limited to, that of FIGS. 5-7.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. An extension system for an iron roughneck, the iron roughneck comprising an iron roughneck support and a torque wrench and a spinning wrench on the iron roughneck support, the extension system comprising:

a stem, a support column on the stem, a mount movably connected to the support column and movable up and down thereon, a first linkage with a first linkage first end pivotably connected to the mount and, a first linkage second end, a second linkage with a second linkage first end pivotably connected to the first linkage second end and a second linkage second end, a third linkage with a third linkage first end pivotably connected to the second linkage second end and a third linkage second end pivotably connected to the iron roughneck support, raising apparatus connected to the support column for raising and lowering the mount with respect to the support column, powered extension apparatus connected to the mount and to the first linkage, and the first linkage, the second linkage, and the third linkage pivotable and movable by the powered extension apparatus to extend the iron roughneck support away from the support column and to retract the iron roughneck toward the support column, and wherein the powered extension apparatus for extending the iron roughneck comprises at least one powered piston-cylinder apparatus, and wherein the at least one powered piston-cylinder apparatus comprises a housing, an inner floating piston movable within the housing, a shaft extending through the inner floating piston and movable with respect thereto, the shaft having two ends and a shaft piston on one end thereof, the shaft piston movable in the housing, and the shaft having an internal channel through which fluid is flowable from an exterior of the housing into a middle chamber, the inner floating piston and the shaft piston dividing an interior of the housing into three chambers including a first end chamber, the middle chamber, and a second end chamber, the shaft connected to the first linkage, and the shaft piston and the shaft movable by flowing a fluid into the housing to operate the powered extension apparatus at a number of known, discrete positions so that the location of the shaft in the housing may be adjusted to corresponds to the location of the first linkage and to the location of the iron roughneck.

2. The extension system of claim 1 wherein each linkage comprises a parallelogram structure with upper members and lower members, the upper members movable parallel to the lower members, a first connection between the first linkage and the second linkage, the upper members of the first linkage and the upper members of the second linkage pivotably connected to the first connection at a top thereof, the lower members of the first linkage and the lower members of the second linkage pivotably connected to the second connection at a bottom thereof, a second connection between the second linkage and the third linkage, the upper members of the second linkage and the upper members of the third linkage pivotably connected to a second connection at a top thereof, and the lower members of the second linkage and the lower members of the third linkage pivotably connected to the second connection at a bottom thereof.

3. The extension system of claim 1 wherein the raising apparatus and the powered extension apparatus act simultaneously.

4. The extension system of claim 1 wherein the support column is rotatable with respect to the stem.

5. The extension system of claim 1 wherein, during movement of the linkages, vertical height of the iron roughneck remains substantially the same.

6. The extension system of claim 1 wherein, during movement of the linkages, vertical height of the iron roughneck varies no more than plus-of-minus 0.75 inches.

7. The extension system of claim 1 wherein the powered extension apparatus for extending the iron roughneck comprises two spaced-apart powered piston-cylinder apparatuses.

8. The extension system of claim 7 wherein the control system controls the location of the shaft piston.

9. The extension system of claim 8 wherein the inner floating piston is locatable at a pre-set desired position so that, when the inner floating piston is contacted by the shaft piston and the shaft piston ceases movement, the iron roughneck is at a pre-selected position.

10. The extension system of claim 9 wherein the control system includes valve apparatus selectively operable to control flow of fluid to the internal channel of the shaft, to the first end chamber, and to the second end chamber.

11. The extension system of claim 1 wherein the iron roughneck is positionable with respect to lower ends of support rails for a top drive on a rig so that an uppermost part of the extension system is below and spaced-apart from the lower ends of the support rails.

12. The extension system of claim 1 wherein the raising apparatus raises a topmost part of the first linkage to an uppermost height, said uppermost height less than a height of bottom ends of top drive support rails adjacent the extension system.

13. A method for moving an iron roughneck on a rig, the method comprising connecting the iron roughneck to an extension system, the extension system comprising a stem, a support column on the stem, a mount movably connected to the support column and movable up and down thereon, a first linkage with a first linkage first end pivotably connected to the mount and a first linkage second end, a second linkage with a second linkage first end pivotably connected to the first linkage second end and a second linkage second end, a third linkage with a third linkage first end pivotably connected to the second linkage second end and a third linkage second end pivotably connected to the iron roughneck support, raising apparatus connected to the support column and to the mount for raising and lowering the mount on the support, powered extension apparatus connected to the mount and to the first linkage, and the first linkage, the second linkage, and the third linkage pivotable and movable by the powered extension apparatus to move the iron roughneck support with respect to the mount, the shaft piston and the shaft movable by flowing a fluid into the housing to operate the powered extension apparatus at a number of known, discrete positions so that the location of the shaft in the housing may be adjusted to corresponds to the location and moving the iron roughneck with the extension system.

14. The method of claim 13 further comprising simultaneously raising the mount and extending the three linkages thereby raising the iron roughneck and moving the iron roughneck away from the mount.

15. The method of claim 13 further comprising simultaneously lowering the mount and retracting the three linkages thereby lowering the iron roughneck and moving the iron roughneck toward from the mount.

16. The method of claim 13 further comprising raising a topmost part of the first linkage to an uppermost height less than a height of bottom ends of top drive support rails adjacent the extension system.

* * * * *

UNITED STATES PATENT AND TRADEMARK OFFICE

CERTIFICATE OF CORRECTION

PATENT NO. : 7,841,415 B2
APPLICATION NO. : 12/075613
DATED : November 30, 2010
INVENTOR(S) : Brian Daniel Winter It is certified that error appears in the above-identified patent and that said Letters Patent is hereby corrected as shown below:

In column 9, line 66, delete “corresponds” and insert -- correspond --.

In column 11, line 11, delete “corresponds” and insert -- correspond --.

Signed and Sealed this
First Day of February, 2011

David J. Kappos

David J. Kappos
*Director of the United States Patent and Trademark Office*